United States Patent [19]

Kamimura et al.

[11] Patent Number: 4,950,850

[45] Date of Patent: Aug. 21, 1990

[54] PEDAL SWITCH ASSEMBLY

[75] Inventors: Taiji Kamimura; Norio Tomobe, both of Saitama, Japan

[73] Assignee: Honda Giken Kogyo Kabushiki Kaisha, Tokyo, Japan

[21] Appl. No.: 340,860

[22] Filed: Apr. 20, 1989

[30] Foreign Application Priority Data

Apr. 20, 1988 [JP] Japan ..... 63-52915[U]

[51] Int. Cl.[5] ..... H01H 3/14

[52] U.S. Cl. ..... 200/61.89

[58] Field of Search ..... 200/16 B, 16 E, 61.76, 200/61.89, 531, 532, 535, 536; 340/467

[56] References Cited

U.S. PATENT DOCUMENTS

| | | | |
|---|---|---|---|
| 1,321,254 | 11/1919 | Singer et al. | 200/61.89 |
| 1,673,206 | 6/1928 | Safely | 200/61.89 |
| 1,924,248 | 8/1933 | Lewellen | 200/61.89 |
| 2,119,778 | 6/1938 | Crockett, Jr. | 200/16 B |
| 2,170,088 | 8/1939 | Murray et al. | 200/61.12 |
| 2,339,910 | 1/1944 | Centrella | 200/61.89 |
| 3,115,559 | 12/1963 | Cass et al. | 200/61.89 |
| 3,137,774 | 6/1964 | Dow et al. | 200/16 B |
| 3,219,775 | 11/1965 | Carpenter | 200/61.89 |
| 3,313,897 | 4/1967 | Gorsky | 200/61.89 |
| 3,404,246 | 10/1968 | Stimpson | 200/61.89 |
| 3,414,879 | 12/1968 | Holland | 340/467 |
| 3,500,313 | 3/1970 | Nolte, Jr. | 340/467 |
| 3,576,529 | 4/1971 | Garrison | 340/467 |
| 3,766,342 | 10/1973 | Stadelmann | 200/61.89 |
| 4,170,723 | 10/1979 | Arsoy | 200/61.89 |

*Primary Examiner*—J. R. Scott

*Attorney, Agent, or Firm*—Lyon & Lyon

[57] ABSTRACT

A pedal switch assembly for an automobile is provided with two switch mechanisms so that change-over signals indicative of command to change-over first and second control devices used in the automobile into their selected operational states are produced sequentially as a pedal for operating the automobile is depressed. The pedal switch assembly comprises an actuator operatively associated with the pedal, a first switch mechanism adapted to be operated by the actuator when the amount of pedal depressed exceeds a first set value thereby producing the change-over signal for the first control device, and a second switch mechanism adapted to be operated by the actuator when the amount of pedal depressed exceeds a second set value larger than the first set value thereby producing the change-over signal for the second control device. This enables the change-over control of the individual control devices to be performed at their respective proper timings in operative association with the depression of the pedal.

12 Claims, 3 Drawing Sheets

PEDAL SWITCH ASSEMBLY

BACKGROUND OF THE INVENTION

1. Field of the Invention

The present invention relates to a pedal switch assembly operatively associated with an operating pedal for an automobile, such as a clutch pedal and a brake pedal.

2. Description of the Prior Art

There is a conventionally known pedal switch assembly in which as a pedal is depressed down, a change-over signal is produced which is indicative of command to change over each of a plurality of control devices used in an automobile, e.g., a constant speed travel control device, an air-fuel ratio correction control device, an antilock brake control device, and a four wheel drive (4WD) to two wheel drive (2WD) change-over device to a selected operation state of that device.

The plurality of control devices are different in function and purpose of use from one another and hence, the optimal timings for changing over the states of operation of the control devices on depression of the pedal may be different from one another. For example, with the constant speed travel control device, the operation thereof is desired to be released substantially in concurrence with clutching of an operator or driver and for this reason, it is desirable that even with a slight amount of clutch pedal depressed, a change-over signal is produced from the pedal switch assembly. On the other hand, with a control device for controlling the air-fuel ratio of an engine for correction, or controlling the supply of a fuel during a speed-reducing operation, the operation thereof is desired to be released after the clutch is brought into a completely disengaged state and for this reason, it is desirable that a change-over signal is produced from the pedal switch assembly after the amount of clutch release reaches a sufficient large value.

However, the above prior art pedal switch assembly is constructed to simultaneously produce the change-over signals to all of the plurality of control devices when the amount of pedal depressed has exceeded a predetermined value and therefore, it is accompanied by a problem that one or more of the control devices may be released in operation at too early or too late of a timing. When the timing for producing the change-over signal from the pedal switch assembly is set a little early for optimal timing for example, when the operation of the constant speed travel control device is released, mere light placement of an operator's foot onto the clutch pedal (many persons drive with their feet remaining lightly placed on the clutch pedal in this way during normal operation) causes the operation of not only the constant speed travel control device but also the air-fuel ratio correction control device and other devices to be simultaneously released and consequently the air-fuel ratio correction control device and other devices will not effectively function in spite of the fact the clutch is not disengaged yet.

SUMMARY OF THE INVENTION

It is an object of the present invention to provide a pedal switch assembly, such as for an automobile, which is simple in structure and in which the above problems associated with the prior art assembly can be overcome.

To attain the above object, according to the present invention, there is proposed an automobile pedal switch assembly which is constructed so that change-over signals indicative of commands to change over first and second control devices used in an automobile into their selected operational states are produced sequentially as a pedal for operating the automobile is depressed and, more particularly, which comprises an actuator operatively associated with the pedal, a first switch mechanism adapted to be operated by the actuator when the amount of pedal depressed exceeds a first set value, thereby producing the change-over signal for the first control device, and a second switch mechanism adapted to be operated by the actuator when the amount of pedal depressed exceeds a second set value, thereby producing the change-over signal for the second control device.

With the above construction, the timing for producing the change-over signals for the first and second control devices can be staggered in correspondence to the amount of pedal depressed. Therefore, it is possible to select an optimal timing for changing over each individual control device to a selected operational state, thereby properly performing the switching control of each of the individual control device with good accuracy. Moreover, the single actuator can be used for the two switch mechanisms for producing the change-over signals, thereby leading to a simplified structure and a reduction in cost.

The above and other objects, features, and advantages of the invention will become apparent from a reading of the following description of the preferred embodiment as shown in the accompanying drawings.

BRIEF DESCRIPTION OF THE DRAWINGS

Drawings illustrate embodiments of the present invention, wherein

FIG. 5 is a view similar to FIG. 2 but showing a second embodiment.

DESCRIPTION OF PREFERRED EMBODIMENTS

Figure 1:
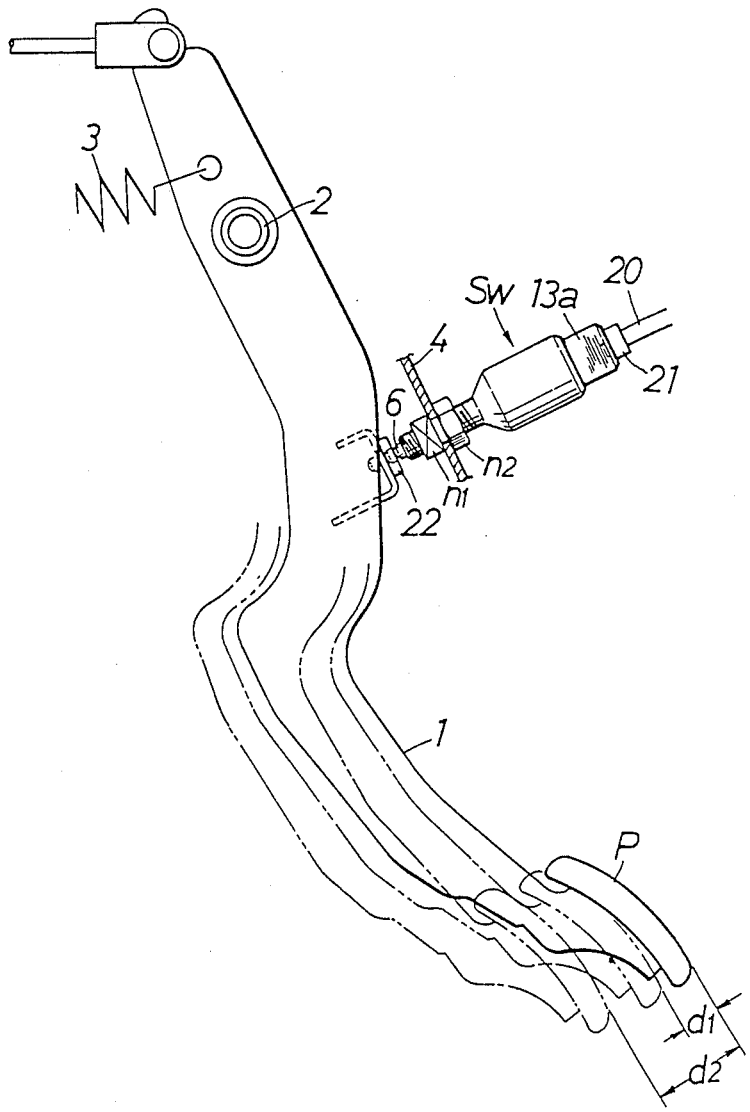
FIG. 1 is a side view schematically illustrating a pedal switch assembly according to a first embodiment, which is attached to a vehicle body.

Embodiments of the present invention will now be described with reference to the accompanying drawings. Referring to FIG. 1 showing a first embodiment, a pedal P having a pedal arm 1 integrally provided thereon is pivotally supported in place on a vehicle body through a pivot 2 for swinging movement in a longitudinal direction. The pedal arm 1 is normally biased by a return spring 3 in a direction to return the pedal P to a non-operated position. A stopper (not shown) is provided on the vehicle body for holding the pedal arm 1 at a fully returned position, as shown by a solid line in FIG. 1 against such biasing force. The pedal P may be a clutch, brake, or accelerator (for very different functions) pedal for any vehicle but for purposes of describing this invention in detail, it will be assumed that pedal P is an automobile clutch pedal.

Figure 2:
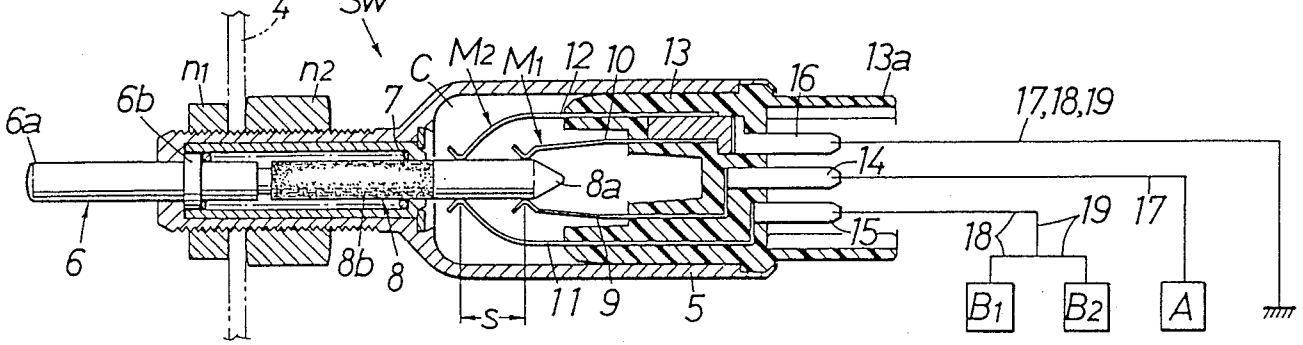
FIG. 2 is a longitudinal sectional side view of the pedal switch assembly.

A pedal switch assembly Sw operatively associated with the clutch pedal P is mounted on a support plate 4 which is fixedly mounted on the vehicle body in proximity to the pedal arm 1. As shown in FIG. 2, the pedal switch assembly Sw comprises a casing 5 secured at its base end to the support plate 4 through nuts $n_1$ and $n_2$, a bar-like actuator 6 slidably mounted in the casing 5, a return spring 7 for biasing the actuator 6 in the direction for causing the outer end 6*a* of the actuator 6 to project outwardly from the casing 5, and first and second switch mechanisms M1 and M2 contained in the casing 5 for controlled switching by the actuator 6. A stopper flange 6*b* is mounted on the outward movement of an outer periphery of the actuator 6 for limiting the outward movement of the actuator 6 relative to the casing 5.

The first switch mechanism M1 is comprised of a movable contact bar 8 integrally connected to an inner end of the actuator 6, and a pair of first resilient, stationary contact plates 9 and 10 with their free ends disposed in an opposed relation in an actuating chamber C within the casing 5. The second switch mechanism M2 is comprised of the movable contact bar 8 and a pair of second resilient, stationary contact plates 11 and 12 with their free ends disposed in the actuating chamber C in an opposed relation at a predetermined distance s spaced longitudinally from the free ends of the first stationary contact plates 9 and 10 in the direction of the sliding movement of the actuator 6. The base portions of the stationary contact plates 9, 10, 11, and 12 are inserted in a cover 13 which is made of an insulating synthetic resin and fitted in an opened fore end portion of the casing 5. Secured to the cover 13 are a first terminal 14 connected to one of the first stationary contact plates 9, a second terminal 15 connected to one of the second stationary contact plates 11, and a third terminal 16 connected to the other first and second stationary contact plates 10 and 12. The terminals 14 to 16 protrude into the recess of a female coupler portion 13*a* integrally formed on the cover 13. The movable contact bar 8 is comprised of a conductive point portion 8*a* entirely formed from a conductive material, and an insulating base portion 8*b* whose outer periphery is formed from an insulating material. Thus, if the conductive point portion 8*a*. is located between the free ends of the first stationary contact plates 9 and 10, the first switch mechanism M1 is in a closed state, while if the insulating base portion 8*b* is located between the free ends of the first stationary contact plates 9 and 10, the first switch mechanism M1 is in an opened state. Likewise, if the conductive point portion 8*a* is located between the free ends of the second stationary contact plates 11 and 12, the second switch mechanism M2 is in a closed state, while if the insulating base portion 8*b* is located between the free ends of the second stationary contact plates 11 and 12, the second switch mechanism M2 is in an opened state.

By way of an example, in the illustrated embodiment of FIG. 1 there are provided a constant speed travel control device A for automatically maintaining the travel speed of an automobile at a given value, an air-fuel ratio correction control device B1 for controlling the amount of secondary air introduced into an intake pipe depending upon loading of an engine to control an air-fuel mixture at a theoretical air-fuel ratio, and a fuel cut control device B2 for cutting the supply of a fuel by closing a through-passage on a primary side of a carburetor during a speed-reducing operation of the engine, thereby providing a decrease in heat load of the exhaust system catalyst and a reduction in specific fuel consumption during speed reduction. The structures of the devices A, B1, and B2 are conventionally well-known and hence, the description thereof is omitted, but it should be noted that the operation of any of the control devices A, B1, and B2 or other devices should be of the type requiring release upon depression of the pedal P. An operation-releasing signal circuit 17 extending out of a signal input of the constant speed travel control device A is connected to the first terminal 14 and operation-releasing signal circuits 18 and 19 extending out of respective signal inputs of the air-fuel ratio correction control device B1 and the fuel cut control device B2 are connected to the second terminal 15. Further, the signal circuits 17 and 19 are connected at their electrical ground sides to the third terminal 16. Signal conductors constituting each of the signal circuits 17 to 19 are bundled to form a single cord 20 (see FIG. 1), and a male coupler 21 provided on the end of the cord 20 is removably connected to the female coupler portion 13*a*.

The reference numeral 22 in FIG. 1 is an engagement member fixedly mounted on the pedal arm 1 to mate with the outer end 6*a* of the actuator 6.

Figure 3:
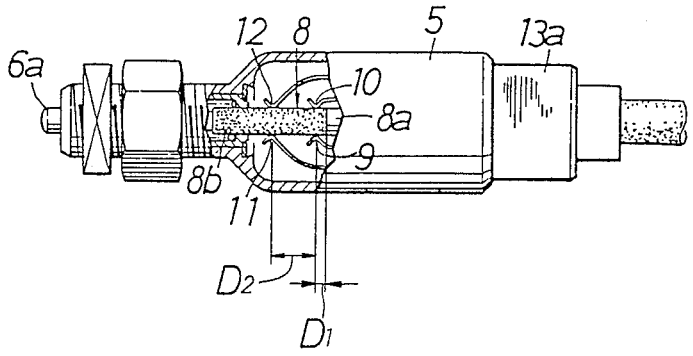
FIGS. 3 and 4 are operational side views of the pedal switch assembly in different stages of operation than shown in FIG. 2.

The operation of this embodiment will be described below. Without the clutch pedal P depressed and being at the return limit (shown by the solid line in FIG. 1), the amount of actuator 6 pushed into the casing 5 by the pedal arm 1 is maximum and, as shown in FIG. 3, the free ends of the first stationary contact plates 9 and 10 and the free ends of the second stationary contact plates 11 and 12 are all in contact with the insulating base portion 8*b* of the movable contact bar 8, so that the first and second switch mechanisms M1 and M2 and thus the signal circuits 17, 18, and 19 are open. Therefore, in this condition, no operation-releasing signal is supplied to the control devices A, B1, and B2 through the signal circuits 17, 18, and 19 and hence, the control devices A, B1, and B2 continue to operate normally insofar as they satisfy other conditions of operation (however, the operation of the constant speed travel control device A may be started or stopped by the driver, as is well known).

Figure 4:
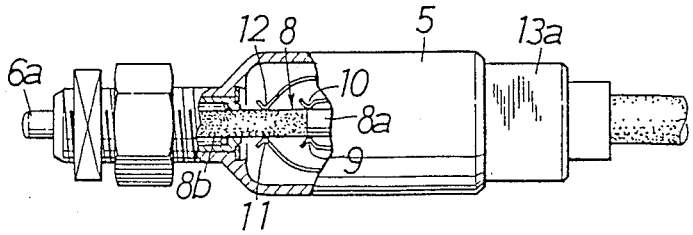

If the clutch pedal P is lightly depressed from the above-described condition within a range of play margin thereof (i.e., without starting to operate the clutch) to give an amount of depression exceeding a first set value $d_1$ (FIG. 1), the actuator 6 moves to follow the pedal arm 1 a distance $D_1$ (FIG. 3), causing the conductive point portion 8*a* of the movable contact bar 8 to come into contact with the free ends of the first stationary contact plates 9 and 10, as shown in FIG. 4, so that the first switch mechanism M1 and thus the signal circuit 17 is closed. This causes the operation of the constant speed travel control device A to be immediately released, but the other control devices B1 and B2 continue to operate.

If the clutch pedal P is further depressed down sufficiently beyond the play margin to give an amount of depression exceeding a second set value $d_2$ (FIG. 1), the actuator 6 moves to follow the pedal arm 1 a distance $D_2$ (FIG. 3), causing the conductive point portion 8*a* of the movable contact bar 8 to come into contact with the free ends not only of the first stationary contacts 9 and 10 but also of the second stationary contacts 11 and 12, so that the second switch mechanism M2 and thus the signal circuits 18 and 19 are closed. This causes the operation of the air-fuel ration correction control device B1 and the fuel cut control device B2 to be also immediately released.

In the above-described embodiment, the constant speed travel control device A constitutes a first control device in accordance to the present invention, while either the air-fuel ratio correction control device B1 or the fuel cut control device B2 or any other device constitutes a second control device in accordance to the present invention.

The pedal switch assembly has been described as being operatively associated with the clutch pedal in the illustrated embodiment, but it will be understood that the pedal switch assembly can be operatively associated with a brake pedal in the present invention for controlling the release of the same devices or other devices. FIG. 5 shows such a device constructed according to a second embodiment. In this case, the first control device may, for example, be a control circuit E for lighting a brake lamp at the time of depressing the brake pedal which is operatively connected to an outer end 106*a* of an actuator 106, other than or in addition to the constant speed travel control device A shown in the above embodiment and the second control device may, for example, be an antilock brake control circuit F to be switched into an operative state when the brake pedal is depressed, and/or a change-over control device G for changing over the state of the automobile from a four wheel drive mode (4WD) where front wheels and rear wheels of the automobile are operatively connected together to a two wheel drive mode (2WD) where the front and rear wheels are independent of each other, which may be other than or in to the illustrated air-fuel ratio correction control device B1 and fuel cut control device B2. In this second embodiment, the control circuits E and F and the control device G are connected to the pedal switch assembly PW through respective signal circuits 23, 24 and 25. And these circuits and devices E, F and G are placed in operative state when the contacts 9, 10 and 11, 12 are connected via the conductive point portion 8*a* as the brake pedal is depressed, which are in contrast with operations of the devices A, B1 and B2. Also, it will readily appear to those skilled in the art that the present invention may be adapted to operate three or more control devices in timing sequence by providing additional pairs of stationary contacts similar to contacts 9, 10, 11, and 12 at longitudinally spaced contacting locations on the contact bar 8.

What is claimed is:

1. A pedal switch assembly for an automobile for providing change-over signals to at least first and second control devices used in the automobile as a pedal for operating the automobile is depressed, comprising, an actuator operatively associated with said pedal, a first switch mechanism operated by said actuator when the amount by which the pedal is depressed exceeds a first set value thereby producing the change-over signal for said first control device, a second switch mechanism operated by said actuator when the amount by which the pedal is depressed exceeds a second set value larger than said first set value thereby producing the change-over signal for said second control device, and a contact bar for common use with said first and second switch mechanisms, said contact bar being movable by said actuator as the pedal is depressed and having an electrically conductive portion which is extended a distance in a direction of engagement of the contact bar with a first set of contacts for the first switch mechanism and a second set of contacts for the second switch mechanism, said electrically conductive portion of the contact bar being capable of simultaneously engaging said first set of contacts and said second set of contacts at longitudinally spaced locations thereof.

2. A pedal switch assembly for an automobile according to claim 1, wherein said first set value is smaller than a play margin of said pedal, and said second set value is larger than said play margin.

3. A pedal switch assembly for an automobile according to claim 1 or 2, wherein said pedal is a pedal for operating a clutch.

4. A pedal switch assembly for an automobile according to claim 3, wherein said first control device is a constant speed travel control device, and said second control device is a control device for controlling at least one of the group (1) the air-fuel ratio of the engine for correction and (2) the supply of a fuel during a speed-reducing operation.

5. A pedal switch assembly for an automobile according to claim 1 or 2, wherein said pedal is a pedal for operating a brake.

6. A pedal switch assembly for an automobile according to claim 5, wherein said first control device comprises at least one of a constant speed travel control device and a control circuit for lighting a brake lamp; and said second control device comprises at least one of a control device for controlling the air-fuel ratio of an engine for correction, a control device for controlling the supply of a fuel during a speed-reducing operation, an antilock brake control circuit to be switched into an operative state when the brake pedal is depressed, and a change-over control device for changing over the state of the automobile from a four wheel drive mode where front wheels and rear wheels of the automobile are operatively connected together to a two wheel drive mode where the front wheels and the rear wheels are independent of each other.

7. A pedal switch assembly for an automobile according to claim 1, wherein said first and second set of contacts are capable of engaging said contact bar at first and second locations spaced relative to said contact bar movement for electrically closing said first and second switch mechanisms sequentially upon movement of said contact bar.

8. A pedal switch assembly for an automobile according to claim 7, comprising means for connecting said contact bar and actuator and supporting said contact bar and actuator for longitudinal movement.

9. A pedal switch assembly for an automobile according to claim 8, wherein said contact bar includes an electrically nonconductive portion engaged by said first and second set of contacts in the non-depressed condition of the pedal.

10. A pedal switch assembly for an automobile according to claim 9, wherein said electrically conductive portion engages said first set of contacts upon depression of the pedal causing movement of the contact bar and then engages said second set of contacts upon further depression of the pedal.

11. A pedal switch assembly for an automobile according to claims 7, 8, 9 or 10, wherein said actuator is an elongated cylindrical pin mounted in a tubular casing for sliding movement on its cylindrical axis, and said contact bar is an elongated cylindrical extension of said actuator.

12. A pedal switch assembly according to claim 11 wherein said first and second set of contacts comprise a pair of resilient members engaging opposite sides of said contact bar.

* * * * *